US005285847A

United States Patent [19]

Halper et al.

[11] Patent Number: 5,285,847

[45] Date of Patent: Feb. 15, 1994

[54] WATER AND GROUND WATER MONITORING WELL SURGE BLOCK

[76] Inventors: Sharon Halper, 305 Vista Way, Martiner, Calif. 94553; Robert S. Baker, 206 S. Claremont Ave., San Jose, Calif. 95127

[21] Appl. No.: 950,486

[22] Filed: Sep. 25, 1992

[51] Int. Cl.[5] ..... E21B 37/00

[52] U.S. Cl. ..... 166/177; 137/854; 166/326; 417/550

[58] Field of Search ..... 166/326, 177; 417/550, 417/553, 555.2; 137/854, 852, 512.15

[56] References Cited

U.S. PATENT DOCUMENTS

| | | | |
|---|---|---|---|
| 274,308 | 3/1883 | George | 137/854 X |
| 414,044 | 10/1889 | Heath et al. | 417/550 |
| 493,249 | 3/1893 | Cook | 417/553 |
| 681,807 | 9/1901 | Moon | 417/550 |
| 1,699,072 | 1/1929 | Kinney, Jr. | 166/177 |
| 2,250,775 | 7/1941 | Rice | 166/177 |
| 2,312,832 | 3/1943 | Goldwater | 137/854 X |
| 2,895,554 | 7/1959 | Krueger et al. | 166/326 X |

*Primary Examiner*—Hoang C. Dang
*Attorney, Agent, or Firm*—John P. Halvonik

[57] ABSTRACT

The invention is a water well surge block for agitation of particles in water wells. The surge block utilizes a novel one way valve comprising a shaft in connection with a rigid perforated cylinder having an upper and lower surface and a flexible membrane that overlies the upper surface of the membrane. As the surge block moves downward in the well or wellbore the membrane flexes away from said cylinder during downward movement of the block in order to permit the one way flow of fluid upward. The membrane closes against the cylinder to prevent the flow of water as the block moves upward.

8 Claims, 1 Drawing Sheet

WATER AND GROUND WATER MONITORING WELL SURGE BLOCK

FIELD OF THE INVENTION

BACKGROUND OF THE INVENTION

Water well surge blocks are used in the field of underground wells and whose purpose is to agitate or otherwise loosen dirt, mud, silt, sand, etc. for dispersing into the water or other liquid. The particles move upward from the bottom of wells going above the surge block where the water containing the loosened particles is cleaned by filtering and removing the particles. The cleaning process may be performed by machines in the wellbore or above ground. Surge blocks find particular use in water wells and ground water monitoring but the principle of agitating the solution remains the same for oil wells, etc. Typically, such plungers use one way valves that permit the one way flow of water upward towards the cleaning means which may be in the well or above ground. The applicant's invention uses a flexible membrane that overlies a perforated cylinder as the one way valve means. The membrane flexes in one direction to allow the water to flow upward and then flexes against the cylinder to prevent water flow in the other direction, thus trapping the sediments above the surge block.

DESCRIPTION OF THE PRIOR ART

While there are one way valves in the prior art most of these rely on ball valves where a moving ball valve closure moves first one direction to open a valve and then backward to close the valve as the surge block moves downward in the wellbore. None of the one way valves known in this field use the perforated cylinder and flexing membrane as does the applicant's invention.

SUMMARY OF THE INVENTION

The invention is a water well surge block with a novel one-way valve that flexes in relation to a perforated cylinder to allow the upward movement of water as the surge block moves downward in the wellbore. A flexible rubber membrane is attached to a shaft that connects it to a perforated cylinder. The membrane overlies the upper surface of the cylinder and moves away from the cylinder as the block moves downward in the well and water moves upward past the cylinders and membrane. On the upstroke, the membrane is pushed against the cylinder by the initial force of the water and the membrane closes the cylinder to movement of water.

It is an object of the invention to provide a water well surge block with a one way valve that provides a strong suction effect on the water and dirt in order to mix dirt and other particles in the water and facilitate its movement during the downward movement of the surge block in order to remove sediment and other particles from the well.

Another object of the invention is to provide a water well surge block that will not damage the sides of wells.

Another object is to provide a water well surge block that is chemically inert so as to not to contaminate the water in the well.

Another object of the invention is to provide a surge block valve that is unlikely to malfunction due to particles etc.

Yet another objective is to provide a water well surge block valve that will not deteriorate when used for long periods.

Other objectives of the invention will become apparent to those skilled in the art once the the invention has been shown and described.

DESCRIPTION OF THE PREFERRED EMBODIMENT

Figure 1:
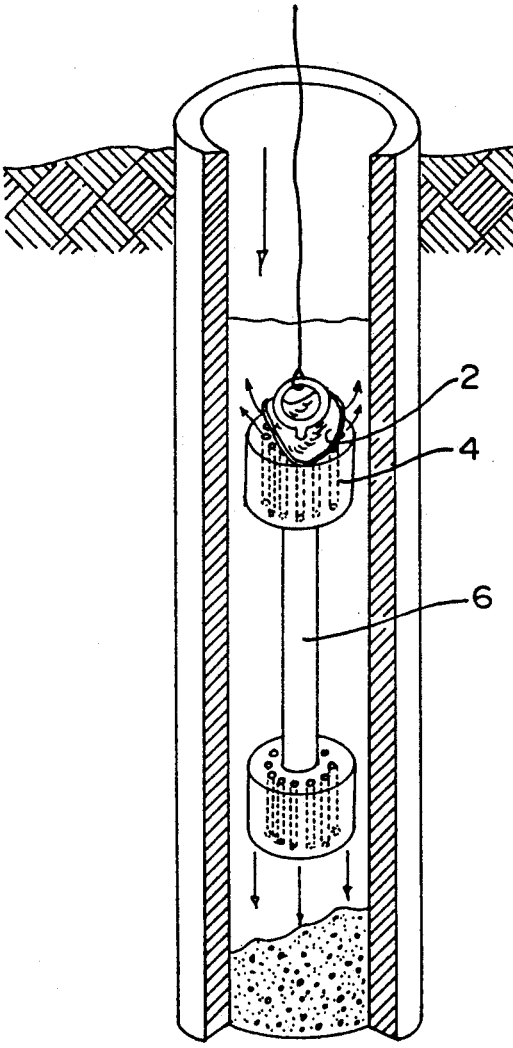
FIG. 1 shows the overall construction of the water well surge block and the flexing of the membrane during the downstroke.

The water well surge block is substantially as shown in FIG. 1. The block is an assembly comprising a perforated cylinder 4, a membrane 2 in connection with a shaft 6. There is a second cylinder 8 connected to the flange and located some distance beneath the first cylinder. This cylinder is substantially like the first cylinder but there is no membrane in connection with it.

The membrane 2 is typically made of rubber or a rubber coated fabric and overlies the perforated cylinder. The perforations extend through the height of the cylinder and are shown as dotted lines. The cylinder and membrane are connected near the center of each through the shaft that is in connection with equipment at the top of the well for moving the block up and down.

Figure 2:
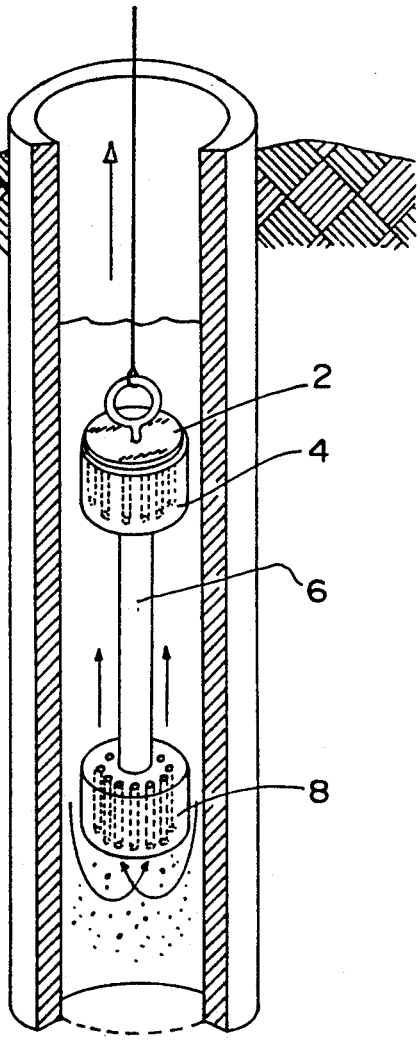
FIG. 2 shows the construction of the water well block and the closing of the membrane during upstroke.

The cylinders should be rather heavy in order to effect the mixing of water and particles in the well. Probably about 4–8 lbs. The height may be 2–48". The cylinders should fit rather tightly in the well in order to mix and create the suction. However, some water may go around the edge of the cylinder on the upstroke, this is shown by arrows in FIG. 2. As the block moves downward during the downstroke the rush of the water will force the membrane away from the plate, see FIG. 1. This, of course, lets water, sediment, particles, etc. flow through the cylinder and upward to the top of the well where there will be equipment to remove water, the mud, sand and silt particles out of the water. This equipment can be located at the top of the wellbore or on the surface of the ground. This equipment will clean the water in the well of sediment and particles.

The membrane would, preferably, be made of rubber or rubber coated fabric but any sort of resilient material will do. It is important that the material be able to withstand the long-term effects of underwater placement and the effects of organic and inorganic chemicals present in the sediment that could lead to deterioration.

During the upstroke the block moves upward in the well and the membrane is forced against the cylinder and preventing flow in the well or wellbore. The closing of the membrane against the cylinder is quite water tight and this prevents fluids from moving out of the area above the block. The effect, then, is to create a suction or vacuum effect beneath the block which applies additional pressure on the mud, silt, etc. to loosen it. The effect then is to create a one way valve that permits the movement of water on the downstroke but not on the upstroke.

The surge block may be build of any size to accommodate wells in existence. Typical water wellbores come in sizes e.g. 2", 4", 6", 8" diameters and the surge block will be sized accordingly leaving a little room at the sides for up and down movement of the block.

It is believed that the use of the flexing membrane increase the suction effect on the water and sand silt, etc. that is forced upward through the cylinder on the down stroke. The membrane flexes in a direction away from the cylinder and as it is of rather a large surface area (relatively speaking) this increases the suction force on the water and aids in mixing the particles (mud, sand, silt, etc.) into the water during the downstroke. The use of the membrane and cylinder also provides a nearly water-tight fit on the upstroke, creating a suction effect on the mud, sand and silt below thereby loosening it.

The use of the flexing membrane also prevents damage to the sides of the well or wellbore. As the membrane flexes, it moves away from the sides of the well preventing damage.

As stated previously, the water well surge block invention need not be used only in water wells or ground water monitoring wells although that is the primary usage of such surge blocks today.

Preferably the holes, or perforations, in the cylinder should be about 1/5 to 1" in diameter depending upon the diameter of the well for which the surge block is being used. It is found that this is the preferred size as it permits. The cylinder may be about 2-48" in height.

The cylinder is preferably made of strong materials, e.g. metals, etc. Aluminum or stainless steel is often preferred due it resistance to corrosive effects and high strength.

I claim:

1. A water well surge bock apparatus for agitating sand and gravel particles within well shafts by up and down motion, said apparatus comprising: upper and lower surge blocks, said blocks comprising cylindrical portions having an upper and lower surface, a shaft in connection with said upper and lower surge blocks, said upper surge block connected to said shaft at a point above said lower surge block, said upper surge block having a flexible membrane in connection with said upper surface of said surge block for flexing away from said upper surface upon downward movement of said surge block, said upper surge block having a plurality of apertures running through said cylindrical portion and in connection with said upper and lower surfaces of said upper surge block, said lower surge block having a plurality of apertures running through said cylindrical portion and in connection with said upper and lower surfaces of said lower surge block, said apertures of size suitable to retard downward movement of said particles when said apparatus moves upward.

2. The apparatus of claim 1 wherein said apertures are about ½" to 1" in diameter.

3. The apparatus of claim 2 wherein said flexible membrane is made of rubber material.

4. The apparatus of claim 2 wherein said flexible membrane is made of rubber-coated fabric.

5. The apparatus of claim 3 wherein said surge blocks are made of aluminum.

6. The apparatus of claim 3 wherein said surge blocks are made of stainless steel.

7. The apparatus of claim 4 wherein said surge blocks are made of aluminum.

8. The apparatus of claim 4 wherein said surge blocks are made of stainless steel.

* * * * *